US005104325A

United States Patent [19]

Mitani et al.

[11] Patent Number: 5,104,325

[45] Date of Patent: Apr. 14, 1992

[54] LOW PROFILE ELECTRICAL CONNECTOR FOR PRINTED CIRCUIT BOARD

[75] Inventors: Ikujiro Mitani; Fumio Kobayashi, both of Tokyo, Japan

[73] Assignee: Hirose Electric Co., Ltd., Tokyo, Japan

[21] Appl. No.: 646,421

[22] Filed: Jan. 28, 1991

[30] Foreign Application Priority Data

Feb. 27, 1990 [JP] Japan ..... 2-18356[U]

[51] Int. Cl.[5] ..... H01R 9/09

[52] U.S. Cl. ..... 439/63; 439/78; 439/350; 439/581

[58] Field of Search ..... 439/63, 78, 80, 81, 439/83, 581

[56] References Cited

U.S. PATENT DOCUMENTS 3,179,912 4/1965 Huber et al. ..... 439/63
4,583,813 4/1986 Yamada ..... 339/91 R
4,632,492 12/1986 Yamada ..... 439/350
4,861,271 8/1989 Bogar et al. ..... 439/63

*Primary Examiner*—Paula A. Bradley
*Attorney, Agent, or Firm*—Kanesaka & Takeuchi

[57] ABSTRACT

A low profile electrical connector for mounting on a printed circuit board, which includes a substantially rectangular housing (1) made from a conductive material and having a mounting leg (5) extending downwardly from a side thereof; a dielectric block (2) fitted into a bottom of the housing and having a supporting rib (6) extending upwardly from an upper surface thereof and a slot (7) extending downwardly along a side of the supporting rib; a substantially U-shaped contact element (3) made from a conductive sheet and fitted over the supporting rib, the contact element having a short leg (8) bent outwardly for making a resilient contact portion and a long leg (9) projecting downwardly from the dielectric block through the slot for making a connection portion.

5 Claims, 3 Drawing Sheets

LOW PROFILE ELECTRICAL CONNECTOR FOR PRINTED CIRCUIT BOARD

BACKGROUND OF THE INVENTION

1. Field of the Invention

The present invention relates generally to electrical connectors to be mounted on a printed circuit board (PCB) and, more particularly, to a low profile electrical connector for a coaxial cable.

2. Description of the Prior Art

Japanese UM Patent Application Kokai No. 61-99980 discloses a coaxial cable connector to be mounted on a PCB such as shown in FIGS. 4A and 4B. The connector includes a tubular conductive shell 110 having an upper opening 111 for receiving a mating connector and connection terminals 117 extending downwardly for connection with a PCB. A pair of dielectric blocks 120 and 130 are fitted into a lower half of the conductive shell 110 for supporting a terminal 140. The terminal 140 has an upper tubular contact portion 141 for receiving the central terminal of a mating connector and a lower projecting portion which is to be connected to a conductor of the PCB.

The upper half of the conductive shell 110 defines a space for receiving a mating connector and has circumferential slits for forming resilient finger members which firmly grip the conductive shell of a mating connector upon plugging.

However, the conventional coaxial cable connector has the following disadvantages:

(1) The connector has a space for receiving a mating connector above the contact portion 141 of the terminal 140 so that it has a high profile and is not usable in limited spaces.

(2) It is difficult to make the tubular conductive shell 110 and the tubular terminal 140 with high precision.

(3) The distance between the terminal portion 140 and the contact portion 141 is so small that the soldering flax can adhere to the contact portion 141, making a poor contact with the central conductor of a mating connector.

(4) It is difficult for an assembling robot to grip the tubular conductive shell. In addition, the circumferential slits make the conductive shell so weak that it is easy for the robot to deform the conductive shell, further lowering the accuracy.

SUMMARY OF THE INVENTION

Accordingly, it is an object of the invention to provide a compact electrical connector which is easy to use and low in the unit manufacturing costs.

According to the invention there is provided a low profile electrical connector for mounting on a printed circuit board, which includes a substantially rectangular housing made from a conductive material and having a mounting leg extending downwardly from a side thereof; a dielectric block fitted into a bottom of the housing and having a supporting rib extending upwardly from an upper surface thereof and a slot extending downwardly along a side of the supporting rib; a substantially U-shaped contact element made from a conductive sheet and fitted over the supporting rib, the contact element having a short leg bent outwardly for making a resilient contact portion and a long leg projecting downwardly from the dielectric block through the slot for making a connection portion.

According to the invention, the dielectric block is fitted into the bottom of the conductive housing, and the U-shaped contact element is fitted over the supporting rib, with the short leg resiliently bent outwardly and the long leg projecting from the dielectric block through the slot making a connection portion.

The electrical connector is mounted on a printed circuit board by inserting the mounting legs and the connection portion into respective apertures of the PCB and soldering them to respective conductors of the PCB for making electrical connections. A mating connector is fitted into this electrical connector so that the contact element comes into contact with the resilient contact portion of the electrical connector.

The above and other objects, features, and advantages of the invention will be more apparent from the following description when taken in conjunction with the accompanying drawings.

DESCRIPTION OF THE PREFERRED EMBODIMENT

Figure 1:
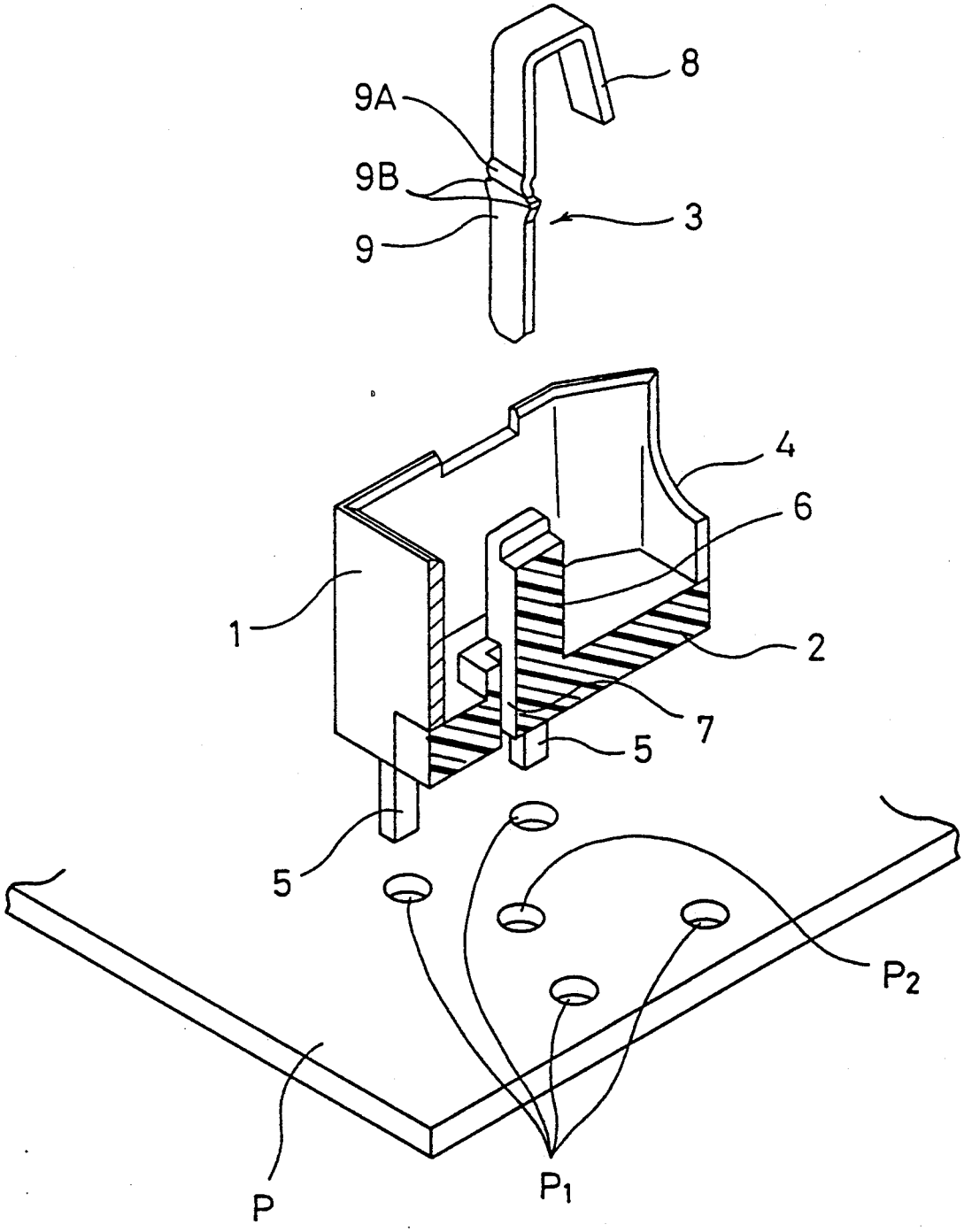
FIG. 1 is an exploded perspective view of a low profile connector according to an embodiment of the invention.

In FIG. 1, a printed circuit board P has apertures P1 and P2 for receiving mounting legs 5 which extending from the shielding house 1 of a connector and a contact element 3 supported by a dielectric body 2, respectively.

The connector includes a substantially rectangular housing 1 made from a conductive material; a dielectric block 2 fitted into the bottom of the conductive housing 1; and a contact element 3 made by stamping and forming a conductive sheet.

The conductive housing 1 has a U-shaped recess 4 on a side for supporting a coaxial cable when it receives a mating connector. Also, it has mounting legs 5 extending downwardly for securing the connector to a PCB and making a shielding connection.

The dielectric block 2 has a supporting rib 6 extending upwardly from the top surface and a slot 7 extending downwardly along a side of the supporting rib 6 for receiving a contact element 3.

The contact element 3 has a substantially U-shaped form, with a leg member 9 made longer than a leg member 8. The contact element 3 is bent so as to fit over the top portion of the supporting rib 6. The shorter leg member 8 is bent outwardly so as to flex inwardly as it is depressed by the contact element of a mating connector. The length of the longer leg member 9 is set such that when the contact element 3 is fitted over the supporting rib 6, the leg member 9 projects from the bottom of the dielectric block 2 through the slot 7. The leg member 9 has a transverse projection 9A in a middle position and a pair of barbs 9B just below the transverse projection for preventing its falling off from the dielectric block 2.

The connector is assembled by inserting the longer leg member 9 of a contact element 3 into the slot 7 for engagement with the dielectric block 2 so that the contact element 3 rests on the supporting rib 6.

The connector is used by inserting the mounting legs 5 into the apertures P1 of a PCB P and soldering them to the conductor of the PCB.

Figure 2:
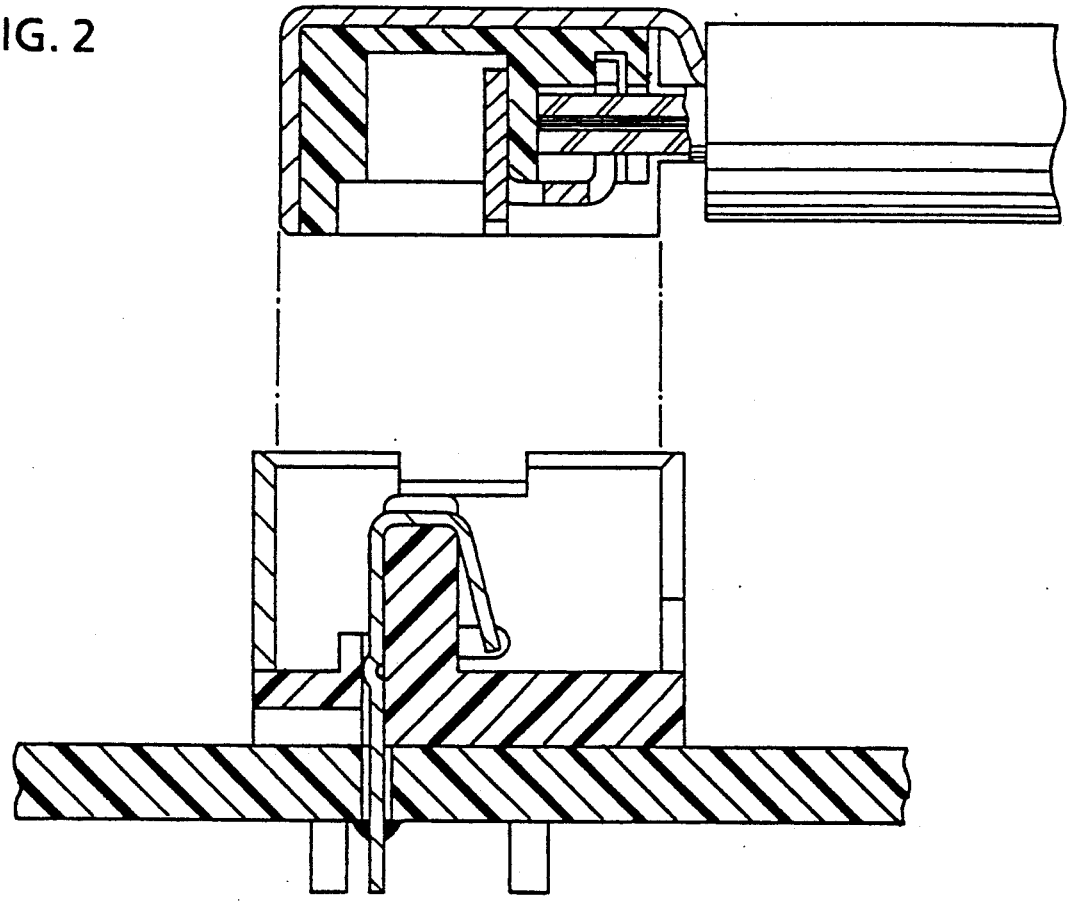
FIG. 2 is a longitudinal section of the low profile connector and a mating connector before coupling.
Figure 3:
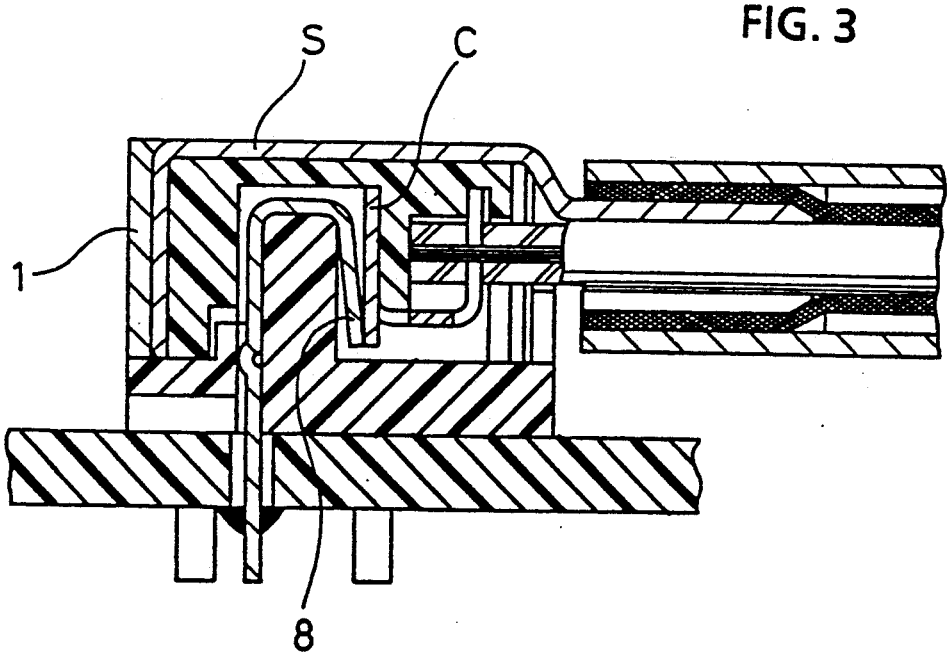
FIG. 3 is a longitudinal section of the low profile connector and the mating connector after coupling.
Figure 4:
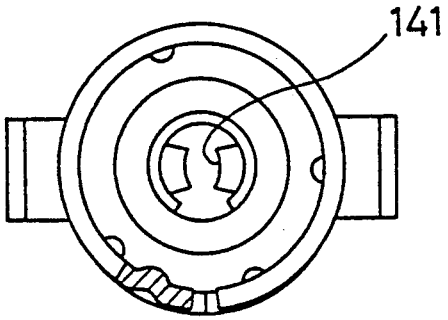
FIG. 4 PRIOR ART
FIG. 4 is a top plan view, partially in section, of a conventional connector.
Figure 5:
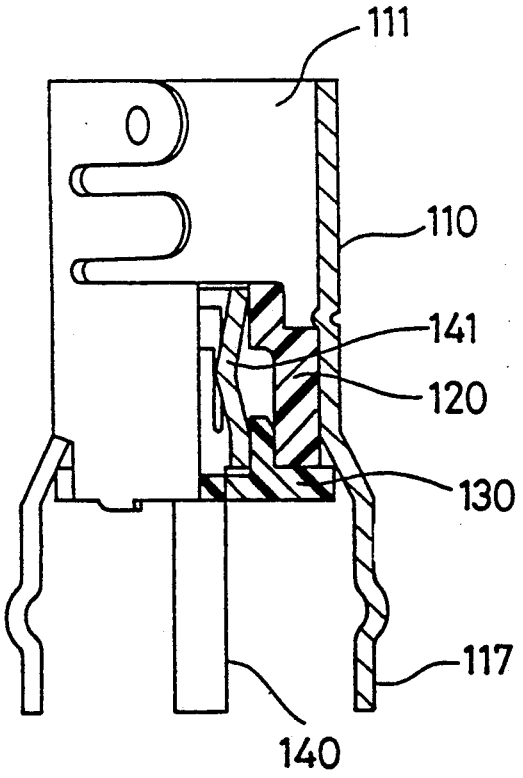
FIG. 5 PRIOR ART
FIG. 5 is a side view, partially in section, of the conventional connector.

As FIGS. 2 and 3 show, a mating connector is fitted into the conductive housing 1 of the connector so that the contact element C of the mating connector comes into contact with the resilient leg member 8 while the shielding housing S of the mating connector comes into contact with an inner surface of the conductive shell 1 for making an electrical connection.

(1) The heights of the contact portion for contact with the contact element of a mating connector and the recess for receiving the mating connector are substantially equal so that it is possible to provide a low profile connector which is usable in limited spaces.

(2) It is possible to make the contact element by stamping and forming a conductive sheet with precision lower than those of the conventional ones.

(3) It is possible to make the contact element long for the height of the finished connector so that the soldering flax does not reach the contact portion, thereby keeping a good contact condition.

(4) Since the conductive housing is rectangular, it is easy for an assembling robot to grip the connector for assembling without any substantial deformation.

We claim:

1. A low profile electrical connector for mounting on a printed circuit board, which comprises:

a substantially rectangular housing made from a conductive material so as to have four flat side walls, one of which has a U-shaped cutout to receive and support a coaxial cable and having at least one mounting leg extending downwardly from one of said side walls;

a dielectric block fitted into a bottom of said rectangular housing to seal said bottom so that said rectangular housing has a top opening into which a mating connector is fitted in a direction perpendicular to an axial direction of said coaxial cable and having a supporting rib extending upwardly from an upper surface thereof and a slot extending downwardly along a side of said supporting rib;

a substantially U-shaped contact element made from a conductive sheet and fitted over said supporting rib, said contact element having a short leg bent outwardly for providing resilient flexibility and a long leg projecting downwardly from said dielectric block through said slot.

2. The low profile electrical connector of claim 1, wherein said long leg has a transverse projection for frictionally fitted into said slot.

3. The low profile electrical connector of claim 2, wherein said long leg has a barb member below said transverse projection for engagement with said dielectric block within said slot, thereby securing said contact element over said supporting rib.

4. A low profile electrical connector for mounting on a printed circuit board, which comprises:

a substantially rectangular housing made from a conductive material and having a mounting leg extending downwardly from a side thereof;

a dielectric block fitted into a bottom of said housing and having a supporting rib extending upwardly from an upper surface thereof and a slot extending downwardly along a side of said supporting rib;

a substantially U-shaped contact element made from a conductive sheet and fitted over said supporting rib, said contact element having a short leg bent outwardly for providing resilient flexibility and a long leg projecting downwardly from said dielectric block through said slot;

said supporting rib has a stepped top for preventing said contact element from moving in a direction perpendicular to a flexing direction of said short leg.

5. A low profile coaxial connector assembly for a printed circuit board comprising:

a substantially rectangular first housing made from a conductive sheet so as to have four flat side walls, one of which has a U-shaped cutout to receive and support a coaxial cable, and having at least one mounting leg extending downwardly from one of said side walls;

a dielectric block fitted into a bottom of said retangular housing to seal said bottom so that said rectangular housing has a top opening into which a mating connector is fitted in a direction perpendicular to an axial direction of said coaxial cable and having a supporting rib extending upwardly from an upper surface thereof and a slot extending downwardly along a side of said supporting rib;

a substantially J-shaped contact element made from a conductive sheet to have a short leg and a long leg and fitted over said supporting rib, said short leg being bent outwardly for providing a spring contact portion while said long leg projecting downwardly from said dielectric block through said slot, said mating connector comprising:

a substantially rectangular second housing having a rear portion connectable to an external conductor of said coaxial cable;

a second dielectric block fitted in said second housing; and a substantially U-shaped contact element made from a conductive sheet so as to have substantially equal two legs, a first leg being formed in a flat contact portion for contact with said spring contact portion in said first housing while a second leg serving as a connection portion for connection with a central conductor of said coaxial cable.

* * * * *